United States Patent [19]

Höck

[11] 4,264,241

[45] Apr. 28, 1981

[54] CHARGING AND DISCHARGING SYSTEM FOR A TEXTILE-FIBRE CHAMBER

[75] Inventor: Franz Höck, Overath, Fed. Rep. of Germany

[73] Assignee: Temafa Textilmaschinenfabrik GmbH, Fed. Rep. of Germany

[21] Appl. No.: 69,638

[22] Filed: Aug. 27, 1979

[30] Foreign Application Priority Data

Aug. 30, 1978 [DE] Fed. Rep. of Germany ..... 2837785

[51] Int. Cl.[3] ..... B65G 53/40

[52] U.S. Cl. ..... 406/109; 46/116; 406/167

[58] Field of Search ..... 406/109, 113, 115, 116, 406/141, 151, 164, 167, 173, 175, 114

[56] References Cited

U.S. PATENT DOCUMENTS

| | | | |
|---|---|---|---|
| 276,879 | 5/1883 | Randolph | 406/109 |
| 2,865,521 | 12/1958 | Fisher et al. | 406/109 |
| 3,588,182 | 6/1971 | Johnson et al. | 406/114 X |
| 3,689,119 | 9/1972 | Weichel | 406/167 X |
| 4,016,994 | 4/1977 | Wurster | 406/109 X |

*Primary Examiner*—James L. Rowland

*Attorney, Agent, or Firm*—Reed, Smith, Shaw & McClay

[57] ABSTRACT

A charging and discharging system for a textile-fibre chamber (1) wherein a movable charging device (6) is connected to a telescopic tube (7). A discharge mill (3) is selectively connected with the telescopic tube (7) through tube coupling means (5). A switching device (13) selectively connects telescopic tube (7) to blower (11) or suction fan (16).

1 Claim, 3 Drawing Figures

CHARGING AND DISCHARGING SYSTEM FOR A TEXTILE-FIBRE CHAMBER

BACKGROUND OF THE INVENTION

1. Field of the Invention

The invention relates to a system for charging and discharging textile fibre chambers. The system includes a charging cyclone device that is inside the chamber and longitudinally movable along the chamber. The charging cyclone device is connected to a blower through a variable-length telescopic tube comprising lengths of tubing that are of progressively larger diameter in a direction towards the cyclone device. The system also includes a discharge mill that is run into the chamber to mix and remove the fibre.

2. Description of the Prior Art

This kind of plant has been previously disclosed for instance in German Offenlegungsschrift No. 26 26 634 and in "Sonderdruck aus Melliand Textilberichte 53 (1972) 1216–1221". The charging cyclone device is a so-called travelling or telescope-fitted cyclone device which is employed for building up layers of fibre material in the chamber. The chamber is emptied by, for example, a mill that mixes and removes the fibre by milling-off in a vertical direction the material stock within the chamber. The discharge mill is connected to a suction or extraction fan by a second telescopic tube that travels together with the discharge mill into the chamber to be emptied.

Since the prior charging and discharging system required separate telescopic tubes for charging and discharging of the chamber, the complete plant was relatively expensive both from manufacturing and maintenance viewpoints. The present invention provides a charging and discharging system that is relatively simplified and that comprises fewer elements than the prior system.

SUMMARY OF THE INVENTION

According to the invention, there is provided a charging and discharging system for a textile-fibre chamber. The system includes a charging cyclone device which is movable, in a direction longitudinally of the chamber, inside the chamber and can be connected to a blower through a variable-length telescopic tube comprising lengths of tubing that are progressively larger in diameter in a direction towards the cyclone device and are suspended from a track. The system further includes a discharge mill that can be run into the chamber and that can be connected through a tube coupling piece to the telescopic tube. The telescopic tube is selectively connected by a switching device to a suction or extraction fan. Surprisingly, the telescopic tube for the charging cyclone device is employed, without impairment of conveying capacity, also as a suction pipe connected to the discharge mill such that air and material in the telescopic tube flow against the original charging direction; in the direction of the progressively smaller pieces of tubing. The inflow of air at the transition zones between the lengths of tubing caused by the partial vacuum in the telescopic tube avoids the deposition of fibre material at the joints of the tube at times when the chamber is emptied.

Other details, objects, and advantages of the invention will become apparent as the following description of a presently preferred embodiment of the invention proceeds.

BRIEF DESCRIPTION OF THE DRAWINGS

In the accompanying drawings, which show, by way of example, an embodiment of the invention.

DESCRIPTION OF THE PREFERRED EMBODIMENT

Figure 1:
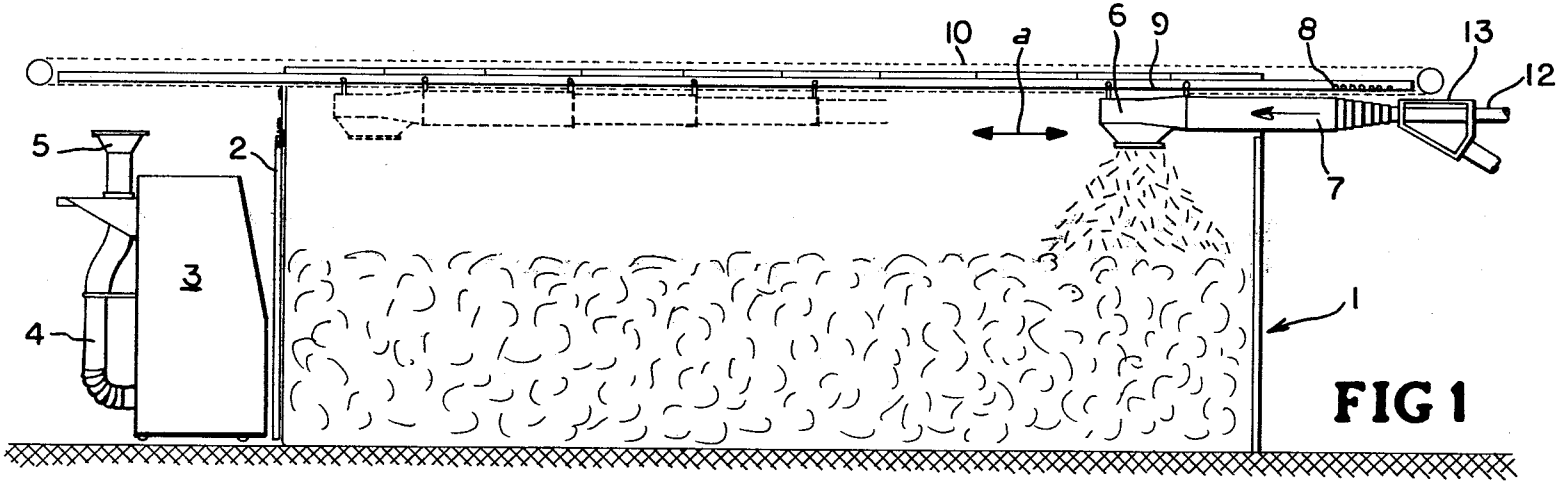
FIG. 1 is a side elevation, partially in section, of a textile-fibre chamber while charging is in progress.

Referring to the drawings, a textile-fibre chamber 1 has substantially the shape of a rectangular block. The front end of the chamber 1 has a sliding wall 2 to permit driving a track-guided discharge mill 3 into chamber 1. The discharge mill mixes the fibres. Discharge mill 3 comprises in known manner an upwards travelling needle studded belt, a detaching roll, a discharging conveyor travelling at right angles to the working direction, travelling means and drive and regulating units. From the discharge conveyor belt, not shown in detail, the material is passed over to a pneumatic conveying system. Discharge mill 3 is equipped with a connecting tube 4 fitted at its free end with a tube coupling 5.

The chamber 1 is charged by means of a charging cyclone device 6 connected to a telescopic tube 7. The telescopic tube 7 comprises lengths of tubing the diameters of which progressively increase in a direction towards the cyclone device and which, as in the cyclone device, are suspended by means of track rollers 8 from an overhead track 9. The charging cyclone device 6 can be moved longitudinally along the chamber in directions of the double ended arrow a by means of a driven hauling cable 10, to charge the fibre chamber 1 by means of a blower 11 (FIG. 3) connected to the telescopic tube. Switching devices 13 and 14 are provided in a charging pipe-line 12 interposed between blower 11 and telescopic tube 7. When the chamber 1 is being emptied, the switching devices 13 and 14 isolate telescopic tube 7 from the charging pipe-line 12 and the blower 11 and connect telescopic tube 7 to a suction or extractor fan 16 through discharge pipe 15. The charging cyclone device 6 is, for the chamber emptying, connected, as shown more especially in FIG. 2, to the tube coupling 5 of discharge mill 3.

Figure 2:
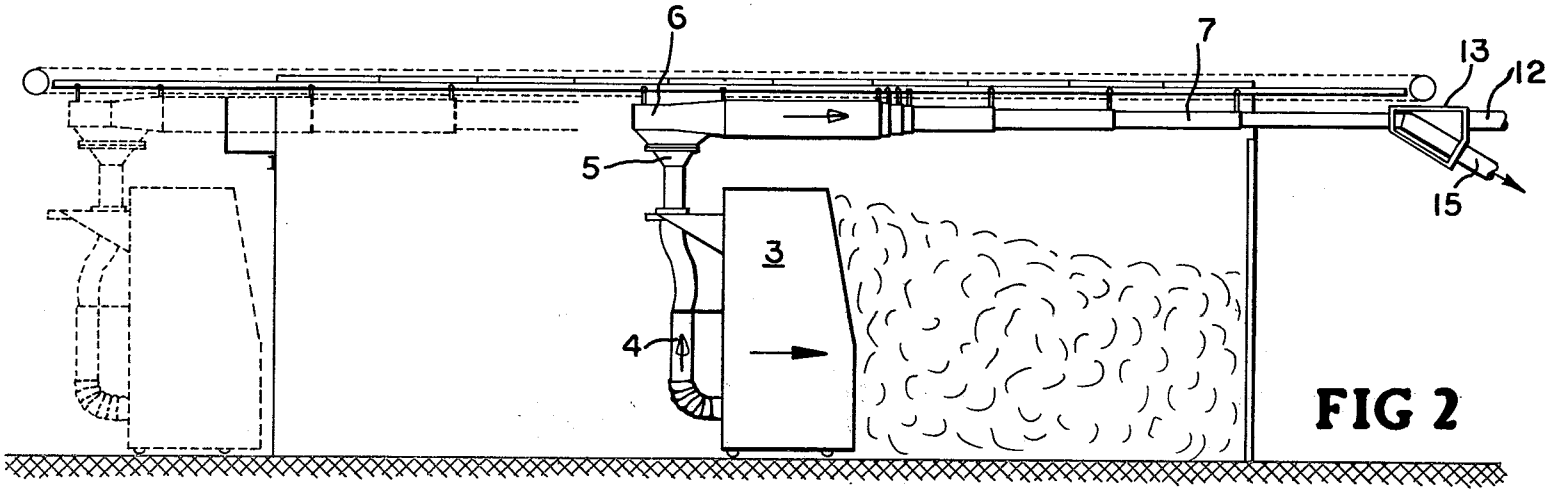
FIG. 2 is a side elevation, partially in section, of the textile-fibre chamber shown in FIG. 1, while discharging is in progress.

FIG. 1 shows diagrammatically charging cyclone 6 in a first intermediate setting and discharge mill 3 in its starting setting while charging of the chamber is in progress. FIG. 2 shows charging cyclone 6 in a second intermediate setting and discharge mill 3 in an operative setting while the chamber is being emptied.

Figure 3:
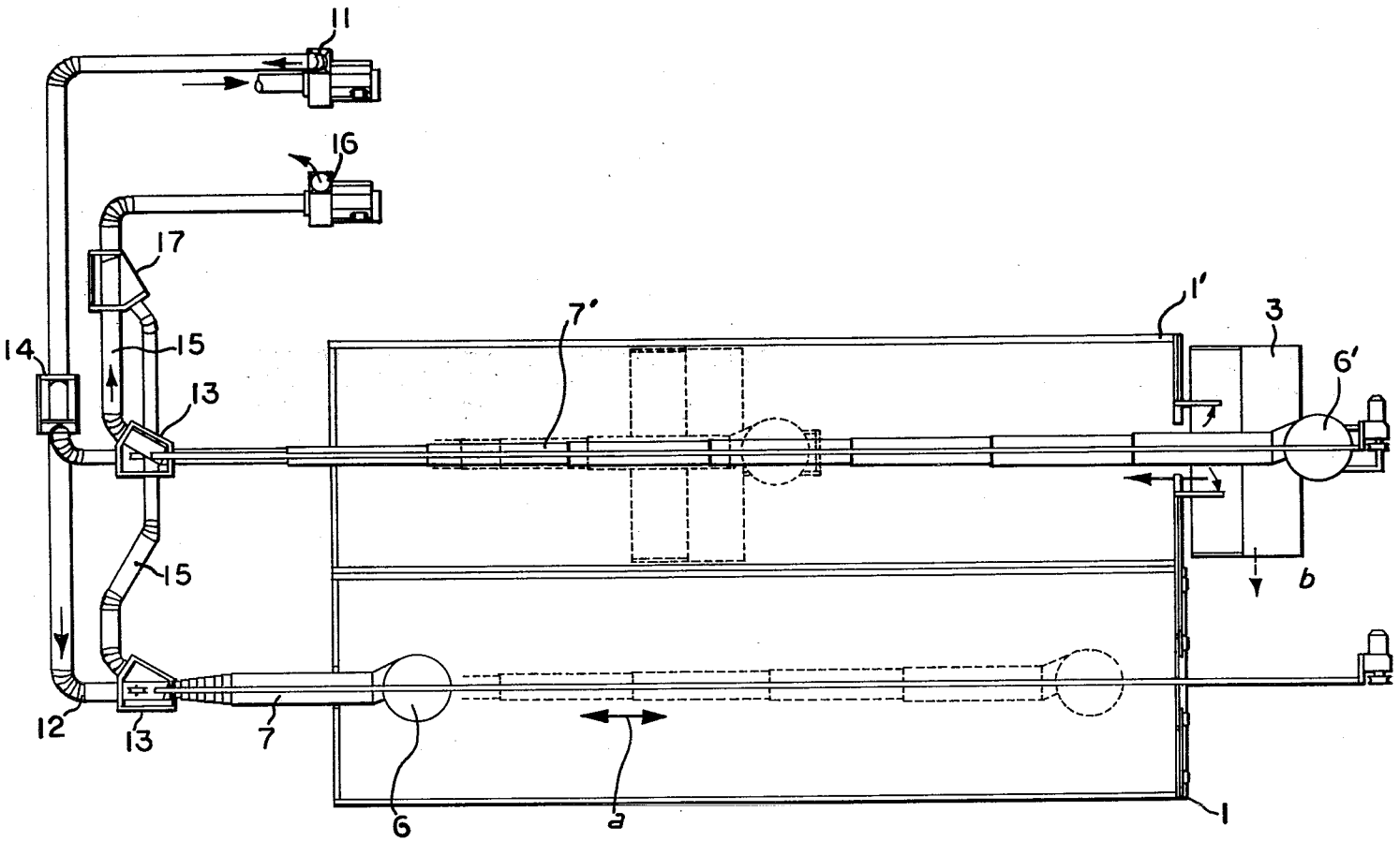
FIG. 3 is a diagrammatically drawn plan view of two textile-fibre chambers of which one is being charged and the other is being discharged.

FIG. 3 shows, diagrammatically, two side-by-side arranged textile-fibre chambers 1, 1', which may, for example, be simultaneously charged (chamber 1) and discharged (chamber 1') in parallel. The individual switching devices 13, 14, and 17 provide the necessary connections at any given time between telescopic tubes 7 or 7' and the blower 11 or suction or extractor fan 16. The discharge mill is associated with both chambers 1, 1' and can travel, in the direction of the arrow b, transversely of the chambers 1, 1'.

While a presently preferred embodiment of the invention has been shown and described, it is to be understood that the invention is not limited thereto but may be otherwise variously embodied within the scope of the following claim.

I claim:

1. A system for charging and discharging a textile-fibre chamber, said system comprising:

a charging cyclone device inside the chamber that is longitudinally movable along the chamber;

a discharge mill that can be run into the chamber;

a tube coupling connected to the discharge mill, said tube coupling selectively coupling the discharge mill to the charging cyclone device;

a variable length telescopic tube connected to the charging cyclone device, said tube having lengths of tubing that are of progressively larger diameters in a direction towards the cyclone device; and a switching device for selectively connecting the telescopic tube to a blower and to a suction fan.

* * * * *